United States Patent [19]

Sawada et al.

[11] Patent Number: 5,064,464

[45] **Date of Patent: * Nov. 12, 1991**

[54] PROCESS FOR PRODUCING ULTRAFINE METAL PARTICLES

[75] Inventors: Yoshiaki Sawada; Yoshiteru Kageyama; Tadashi Teramoto, all of Yokkaichi, Japan

[73] Assignee: Mitsubishi Petrochemical Company Limited, Tokyo, Japan

[ * ] Notice: The portion of the term of this patent subsequent to Feb. 28, 2006 has been disclaimed.

[21] Appl. No.: 453,376

[22] Filed: Nov. 9, 1989

[30] Foreign Application Priority Data

| | | | |
|---|---|---|---|
| Nov. 10, 1988 | [JP] | Japan | 63-284760 |
| Mar. 17, 1989 | [JP] | Japan | 63-65724 |
| May 26, 1989 | [JP] | Japan | 1-133871 |

[51] Int. Cl.[5] ..... B22F 9/30

[52] U.S. Cl. ..... 75/347; 75/348; 75/362

[58] Field of Search ..... 75/362, 347; 423/DIG. 8, DIG. 9

[56] References Cited

U.S. PATENT DOCUMENTS

| | | | |
|---|---|---|---|
| 2,776,200 | 1/1957 | Wallis | 75/362 |
| 2,884,319 | 4/1959 | Fabian et al. | 420/459 |
| 2,900,245 | 8/1959 | Beller | 75/362 |
| 3,918,955 | 11/1975 | Dewelyn | 75/362 |
| 4,629,615 | 12/1986 | Cheng | 423/450 |
| 4,808,216 | 2/1989 | Kageyama et al. | 75/362 |

*Primary Examiner*—R. Dean
*Assistant Examiner*—Margery S. Phipps
*Attorney, Agent, or Firm*—Koda and Androlia

[57] ABSTRACT

The present invention provides a process for producing ultrafine metal particles by gas-phase pyrolysis of 0.1 to 30% by volume transition metal carbonyl compound diluted with a diluent gas to form a mixed gas, which comprises supplying 1 to 30% by volume of the mixed gas of up to 200° C. and 99 to 70 % by volume of a second diluent gas. The second gas heated to at least 400° C., serves as a heat feed source for gas-phase pyrolysis to a reaction zone. The gases are mixed together there to carry out gas-phase pyrolysis in the presence of a magnetic field of at least 100 gauss.

4 Claims, 2 Drawing Sheets

PROCESS FOR PRODUCING ULTRAFINE METAL PARTICLES

BACKGROUND OF THE INVENTION

This invention relates to a process for producing ultrafine metal particles. More specifically, this invention relates to a process for producing ultrafine metal particles having excellent magnetic properties well-suited for, high-density magnetic recording media, i.e., high coercive force and high saturation magnetization in a stable manner over an extended period of time by carrying out gas-phase pyrolysis of transition metal carbonyl compounds under specific conditions.

From, e.g., Japanese Patent Publication Nos. 24316/1968, 11529/1969 and 31809/1977, and U.S. Pat. Nos. 2,983,997 and 2,884,319, it is known to obtain fine metal powders by the gas-phase pyrolysis of transition metal carbonyl compounds such as Fe and Ni.

So far as the present inventors know, however, these publications only disclose granular powders having a particle size on the order of several microns and fail to give such acicular ultrafine metal particles as intended by the present invention and expressed in terms of an average minor axis particle size of up to 0.05 μm. Nor do they disclose any ultrafine metal particles having excellent magnetic properties suited for high-density recording media, viz., high coercive force and high saturation magnetization.

As disclosed in Japanese Patent Publication Nos. 1004/1964 and 16868/1970, Japanese Laid-Open Publication No. 137202/1983, and U.S. Pat. Nos. 3,172,776, 3,200,007 and 3228882, on the other hand, it has been proposed to subject transition metal carbonyl compounds to pyrolysis in a liquid phase where the carbonyl compounds are dissolved in a specific solvent, thereby obtaining ultrafine metal particles dispersed in that solvent.

To the best of the present inventors' knowledge, however, industrial liquid-phase processes for producing ultrafine metal particles have various drawbacks in respect of mass-production and economy when compared with gas-phase processes. For example, it is very difficult to separate the resulting ultrafine metal particles from the solvent used since the metal particles have extremely low apparent density. Moreover, the output of metal particles per solvent is very low, thus requiring a high production cost.

SUMMARY OF THE INVENTION

In view of the state of the art as described above, the present inventors have made intensive studies of gas-phase processes for producing ultrafine metal particles and eventually accomplished the present invention.

Thus, the present invention provides a process for producing ultrafine metal particles by gas-phase pyrolysis of transition metal carbonyl compound diluted with a diluent gas, which comprises supplying 1 to 30% by volume of a mixed gas of up to 200° C. containing transition metal carbonyl compound previously diluted with a diluent gas such that the concentration of the transition metal carbonyl compound ranges from 0.1 to 30% by volume and 99 to 70% by volume of another diluent gas of at least 400° C. serving as a heat feed source for gas-phase pyrolysis to a reaction zone and mixing together there to carry out gas-phase pyrolysis, said gas-phase pyrolysis being carried out in the presence of a magnetic field of at least 100 gauss.

According to the process of the present invention, it is possible to obtain, with considerably increased production efficiency, acicular powders of transition metals which are very fine, e.g., an average minor axis diameter of at most 0.05 μm. The obtained transition metal powders have excellent magnetic properties.

The reason why very fine and acicular metal powders can be obtained by the process of the present invention may be that, since a small quantity of a mixed gas of low temperature containing a metal carbonyl compound diluted with a diluent gas is mixed in the presence of a magnetic field with a large quantity of a diluent gas of high temperature, the heat required for the pyrolysis of transition metal carbonyl compound may be supplied much more rapidly as compared with the case where such heat is supplied from an external heat source, whereby the number of nucleation would be so increased during the formation of particles that the resulting particles can be thus finer.

DETAILED DESCRIPTION OF THE INVENTION

Transition metal carbonyl compound

The transition metal carbonyl compounds to be used in the present invention include carbonyl compounds of Fe, Ni, Co, W, Mo, etc. or mixtures thereof. $Fe(CO)_5$, $Ni(CO)_4$ and $CoH(CO)_4$ each having a low boiling point are preferred.

As regards carbonyl compounds of Mo, W, etc. having a high boiling point, they may be used singly to provide their single metal particles, or they may be dissolved in $Fe(CO)_5$, $Ni(CO)_4$ or $CoH(CO)_4$ as a solvent in a small amount, e.g., 30% by volume or less, and then subjected to pyrolysis so as to obtain particles of their alloys with the solvent metal.

Diluent gas

As the diluent gas, use may be made of any gas with which the object of the present invention is attainable. However, preference is given to an inert gas such as nitrogen or argon; carbon monoxide; hydrogen; or their mixed gases. Such preferred gases may be mixed with other gases such as methane.

Pyrolysis

The pyrolysis according to the present invention is essentially similar to that of the prior art now in operation, except for the dilution of the starting transition metal carbonyl compounds, the introduction of an internal heat source and the application of a magnetic field for gas-phase pyrolysis.

Figure 1:
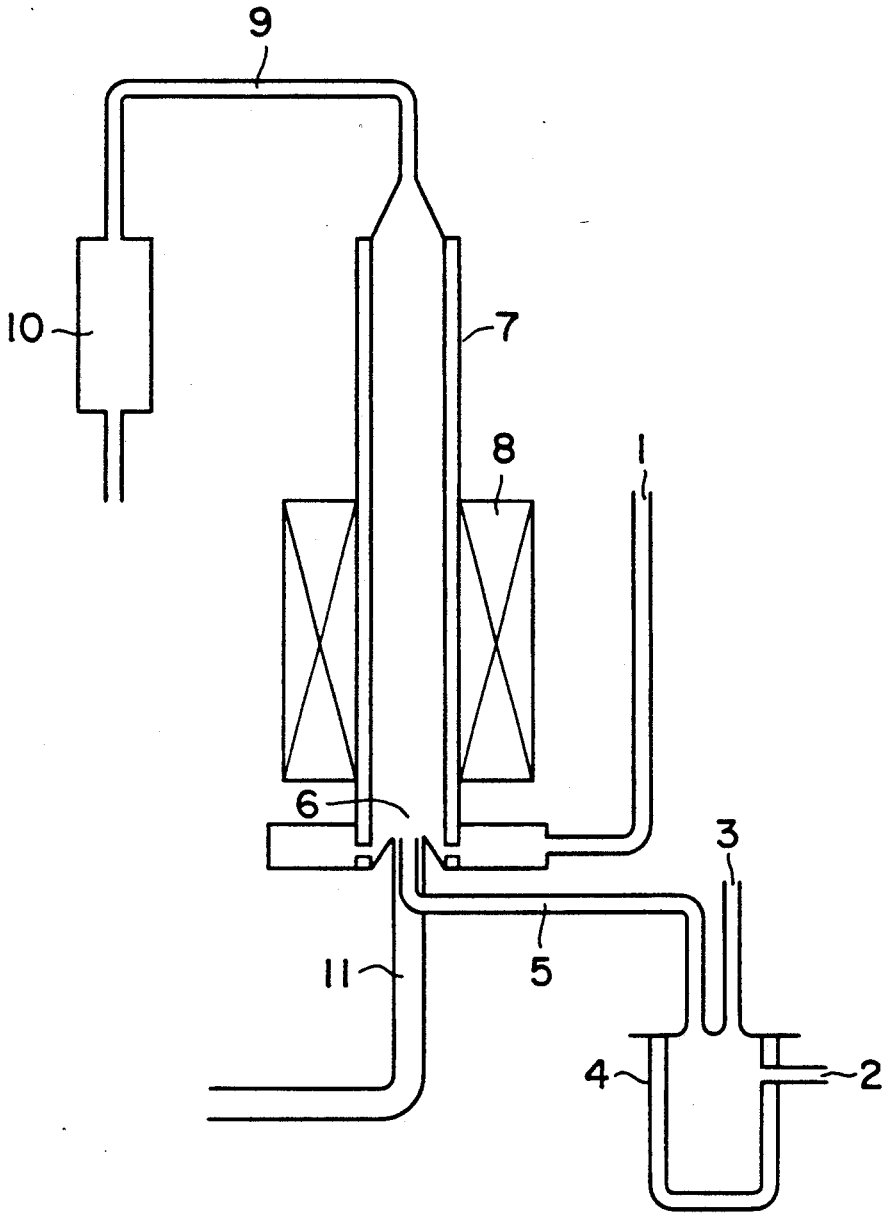
FIG. 1 is a schematic view of one embodiment of apparatuses usable for carrying out the process of the present invention.
Figure 2:
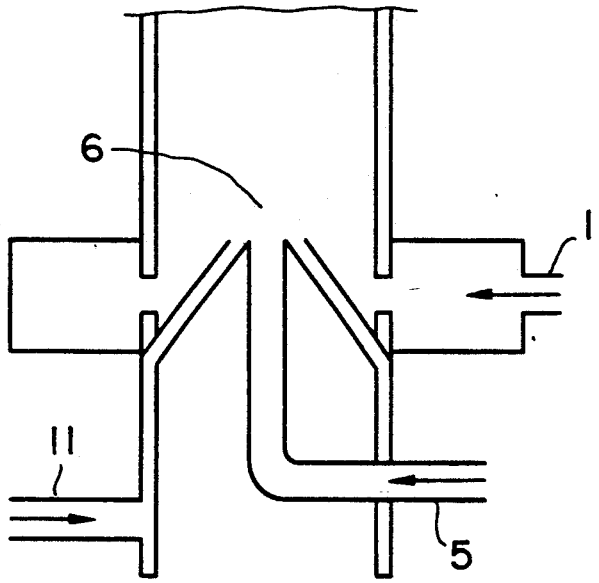
FIGS. 2 and 3 are each an enlarged view of a part of FIG. 1, respectively showing modifications.
Figure 3:
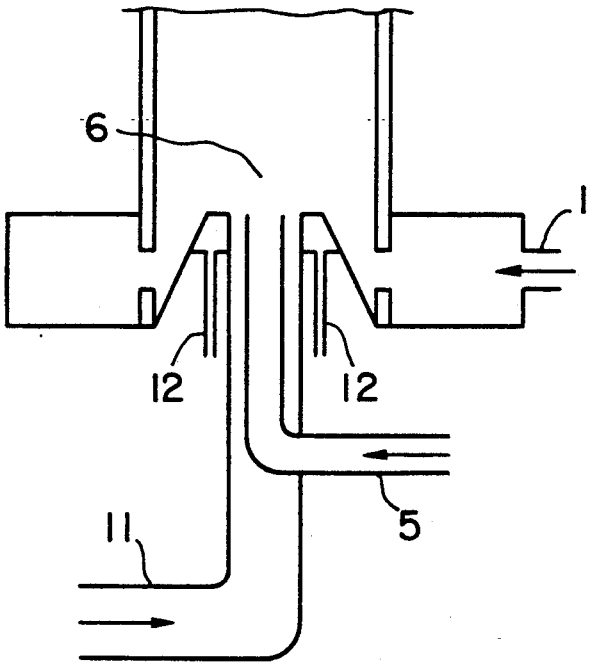

FIG. 1 illustrates one embodiment of apparatuses suited for carrying out the process of the present invention.

Referring to FIG. 1, a diluent gas of high temperature and a low-temperature mixed gas of a transition metal carbonyl compound with a diluent gas are introduced through conduits 1 and 5, respectively, to bring both gases into contact with each other at a position of a nozzle outlet 6 to which a magnetic field is applied, whereby the heat of 300° C. or higher, preferably 400° to 800° C. required for the decomposition of the metal carbonyl compound can be instantaneously supplied from the high-temperature diluent gas.

In order to prevent clogging of the conduit 5 and the nozzle outlet 6 due to the deposition of the decomposed product of the low-temperature metal carbonyl compound, it is preferable to introduce a low-temperature diluent gas through a conduit 11, as will be detailed later.

The mixed gas introduced through the conduit 5 may be obtained by mixing the metal carbonyl compound (introduced through a conduit 2) with the diluent gas (introduced through a conduit 3) at a specific proportion in a mixing chamber 4. The concentration of the transition metal carbonyl compound in the mixed gas introduced through the inlet conduit 5 is in a range of 0.1 to 30% by volume, preferably 0.5 to 25% by volume. At higher concentrations, it is impossible to obtain ultrafine magnetic particles having such a high coercive force as desired in the present invention, since the resulting metal particles have a large particle size. At lower concentrations, on the other hand, there is a drop of productivity.

The mixed gas introduced through the conduit 5 is in a temperature range of 200° C. or lower, preferably 180° to 30° C. and in a quantity of 1 to 30% by volume, preferably 3 to 20% by volume relative to the total feedstock supplied through the conduits 1, 5 and 11. In too small quantities, there is a drop of productivity. In too much quantities, on the other hand, it is impossible to obtain ultrafine particles, since the heat supply for reaction becomes so insufficient that the rate of reaction drops, resulting in increased growth of the resultant metal particles. Too high a temperature of the mixed gas also does not give desired ultrafine particles because of the occurrence of the decomposition of the metal carbonyl compound in the conduit 5.

The diluent gas of high temperature introduced through the conduit 1 is fed at 400° C. or higher, preferably 450° C. or higher (up to 1000° C.) and in a quantity of 96 to 55% by volume, preferably 92 to 70% by volume relative to the total feedstock supplied through the conduits 1, 5 and 11. At too low temperatures or in too small quantities, the heat supply for reaction becomes so insufficient that the rate of reaction considerably drops, and the amount of nucleation is reduced during the formation of metal particles, whereby the metal particles grow to be too large.

The gases brought into contact with each other and mixed together at the position of the nozzle outlet 6 are allowed to reside in a reaction tube 7, for 5 seconds or shorter, preferably 2 seconds or shorter for the gas-phase pyrolysis.

The application of a magnetic field to the reaction system may be achieved with any suitable means 8 such as permanent magnets, electromagnets or solenoid coils. The magnetic field to be applied may be in a range of 100 gauss or higher, preferably 300 gauss or higher, more preferably 400 to 1500 gauss. With the magnetic field thus applied, it is possible to control the acicularity of the resultant ultrafine metal particles, thereby increasing their coercive force.

The ultrafine metal particles formed through pyrolysis are passed through a conduit 9 to a collection chamber 10 for recovery.

It is noted that the feeding through the conduit 11 of the diluent gas of a low temperature of up to 200° C. has the following merits.

(1) Since the heat from the high-temperature diluent gas is prevented from being transmitted to the inlet conduit 5 for the introduction of the metal carbonyl compound, it is possible to avoid clogging of the conduit due to the decomposition of the metal carbonyl compound, thus making prolonged operation of the system possible.

(2) Since the end portion of the conduit 5 for feeding the metal carbonyl compound is not directly exposed to the high temperature of the diluent gas from the conduit 1, the decomposition of the metal carbonyl compound staying in the vicinity of the above end portion is substantially reduced so that the metal particles grow homogeneously into a homogeneous product. This also assures that the system can be operated stably over an extended period of time.

(3) It is unlikely that the reaction of pyrolysis may proceed before sufficient mixing of the metal carbonyl compound with the high-temperature diluent gas. Thus, the growth of particles takes place in a state where uniform reaction concentration and temperature are maintained, ensuring that a product having a sharp particle size distribution can be obtained.

The low-temperature diluent gas, which may be introduced through the conduit 11, is at a temperature of up to 200° C., preferably up to 100° C. and in a quantity of 3 to 15% by volume, preferably 5 to 10% by volume relative to the total feedstock.

Under otherwise conditions, such merits as mentioned above cannot be obtained.

By carrying out the pyrolysis of the transition metal carbonyl compound under the above conditions, it is possible to stably produce ultrafine metal particles having such magnetic properties as expressed in terms of a coercive force of 800 to 2500 oersted and a saturation magnetization of 120 to 200 emu/g.

The ultrafine metal particles obtained according to the present invention are preferably used as high-density recording media. It is understood, however, that they are not limited to such purposes and may find application in various fields for which ultrafine metal particles are needed.

EXPERIMENTAL EXAMPLES

Example 1

With an apparatus as shown in FIG. 1 including a reaction tube of 27 mm in inner diameter and 1 m in length to which a magnetic field of 600 gauss was applied, ultrafine iron particles were formed by the gas-phase pyrolysis of $Fe(CO)_5$ under the following reaction conditions.

(i) High-temperature diluent gas introduced through conduit 1

Nitrogen: 500° C.; 90% by volume of the total feedstock.

(ii) Mixed gas introduced through conduit 5

Nitrogen: 60° C.; 8.5% by volume of the total feedstock.

$Fe(CO)_5$: 60° C.; 1.5% by volume of the total feedstock.

(iii) Residence time: 0.3 seconds.

(iv) Average internal temperature of the reaction tube: 495° C.

By observation with a transmission type electron microscope, the obtained ultrafine iron particles were found to be in an acicular form with a minor axis diameter of 0.02 μm and a major axis diameter of 0.20 μm. The iron particles had a saturation magnetization of 130 emu/g and a coercive force of 1520 Oe.

Example 2

Pyrolysis reaction was carried out in the same manner as in Example 1 except that the average internal temperature of the reaction tube was changed to 475° C. By observation with a transmission type electron microscope, the obtained ultrafine iron particles were found to be in an acicular form with a minor axis diameter of 0.022 μm and a major axis diameter of 0.20 μm. The iron particles had a saturation magnetization of 135 emu/g and a coercive force of 1480 Oe.

Example 3

Pyrolysis reaction was carried out in the same manner as in Example 1 except that $Fe(CO)_5$ in the mixed gas fed through conduit 5 was changed to a mixture of carbonyl compounds of $Fe(CO)_5$: $CoH(CO)_4$=10:1 (molar ratio).

The obtained ultrafine iron particles contained 12% by weight of Co and were in an acicular form with a minor axis diameter of 0.023 μm and a major axis diameter of 0.20 μm, and had a saturation magnetization of 140 emu/g and a coercive force of 1830 Oe.

Example 4

With same apparatus and the same application of a magnetic field as in Example 1, the gas-phase pyrolysis of $Fe(CO)_5$ was carried out under the following conditions, thereby forming ultrafine iron particles.

(i) High-temperature diluent gas introduced through conduit 1
  Nitrogen: 500° C.; 85% by volume of the total feedstock.
(ii) Mixed gas introduced through conduit 5
  Nitrogen: 60° C.; 8.5% by volume of the total feedstock.
  $Fe(CO)_5$: 60° C.; 1.5% by volume of the feedstock.
(iii) Low-temperature diluent gas introduced through conduit 11
  Nitrogen: 60° C.; 5% by volume of the total feedstock.
(iv) Residence time: 0.1 seconds.
(v) Average internal temperature of the reaction tube: 495° C.

By observation with a transmission type electron microscope, the obtained ultrafine iron particles were found to be in an acicular form with a minor axis diameter of 0.02 μm and a major axis diameter of 0.20 μm. The iron particles had a saturation magnetization of 130 emu/g and a coercive force of 1520 Oe.

Example 5

Continuous operation of the apparatus was conducted over an extended period of time under the conditions of Example 4. Magnetic properties were determined on the products sampled at intervals during the operation. The results are shown below.

| Time Elapsed (hours) | Coercive Force (Oe) | Saturation Magnetization (emu/g) |
|---|---|---|
| 5 | 1520 | 130 |

-continued

| Time Elapsed (hours) | Coercive Force (Oe) | Saturation Magnetization (emu/g) |
|---|---|---|
| 10 | 1540 | 131 |
| 15 | 1515 | 129 |
| 20 | 1530 | 130 |

As apparent from the table, the magnetic properties of the product does not substantially change after a long-term operation of the apparatus.

Comparative Example 1

With the same apparatus and the same application of a magnetic field as in Example 1, but supplying heat from an electric furnace set up outside the reaction tube instead of supplying heat from the high-temperature diluent gas, gas-phase pyrolysis of $Fe(CO)_5$ was carried out under the following conditions to produce ultrafine iron particles.

(i) Mixed gas introduced through conduit 5
  Nitrogen: 60° C.; 98.5% by volume of the total feedstock.
  $Fe(CO)_5$: 60° C.; 1.5% by volume of the total feedstock.
(ii) Residence time: 1.0 second.
(iii) Average internal temperature of the reaction tube:
  Early period of 0 to 0.3 second: 270° C.
  Later period of 0.3 to 1.0 second: 500° C.

By observation with a transmission type electron microscope, the obtained ultrafine iron particles were found to be in an acicular form with a minor axis diameter of 0.035 μm and a major axis diameter of 0.40 μm. The iron particles had a saturation magnetization of 138 emu/g and a coercive force of 1280 Oe. The amount, calculated as weight per hour, of the product was as little as 1/20 of that of Ex. 1.

Example 6

With the same apparatus as in Example 1, but with the application of a magnetic field of 1000 gauss, gas-phase pyrolysis of $Fe(CO)_5$ was carried out under the following conditions.

(i) High-temperature diluent gas introduced through conduit 1
  Carbon monoxide: 640° C.; 90% by volume of the total feedstock.
(ii) Mixed gas introduced through conduit 5
  Carbon monoxide: 60° C.; 9% by volume of the total feedstock.
  $Fe(CO)_5$: 60° C.; 1% by volume of the total feedstock.
(iii) Residence time: 0.2 seconds.
(iv) Average internal temperature of the reaction tube: 570° C.

The conversion of $Fe(CO)_5$ fed to the product was 97%. By observation with a transmission type electron microscope, the obtained ultrafine iron particles were found to be in an acicular form with a minor axis diameter of 0.02 μ and a major axis diameter of 0.4 μ. The iron particles had a saturation magnetization of 138 emu/g and a coercive force of 1500 Oe.

Example 7

Pyrolysis reaction was carried out in the same manner as in Example 6 except that $Fe(CO)_5$ in the mixed gas fed through conduit 5 was changed to a mixture of carbonyl compounds of $Fe(CO)_5$: $CoH(CO)_4$=10:1 (molar ratio).

The obtained ultrafine metal particles contained 8% by weight of Co and were in an acicular form with a minor axis diameter of 0.026 μm and a major axis diameter of 0.27 μm, and had a saturation magnetization of 152 emu/g and a coercive force of 1750 Oe.

Comparative Example 2

With the same apparatus and the same application of a magnetic field as in Example 1, but supplying heat from an electric furnace set up outside the reaction tube instead of supplying heat from the high-temperature diluent gas, gas-phase pyrolysis of $Fe(CO)_5$ was carried out under the following conditions.

(i) Mixed gas introduced through conduit 5

Nitrogen: 640° C.; 99% by volume of the total feedstock.

$Fe(CO)_5$: 60° C.; 1% by volume of the total feedstock.

(ii) Residence time: 1.5 seconds.

(iii) Average internal temperature of the reaction tube:

Early period of 0 to 0.4 second: 340° C.

Later period of 0.3 to 1.0 second: 580° C.

The obtained ultrafine iron particles were in an acicular form with a minor axis diameter of 0.052 μm and a major axis diameter of 0.60 μm, and had a saturation magnetization of 155 emu/g and a coercive force of 630 Oe.

Comparative Example 3

Pyrolysis reaction was carried out in the same manner as in Example 6 except that the magnetic field applied was changed to 50 gauss. The product was in a chain form with a coercive force of 380 Oe and a saturation magnetization of 160 emu/g.

What is claimed is:

1. A process for producing ultrafine metal particles having an average minor axis diameter below 0.05 μm by gas-phase pyrolysis of a transition metal carbonyl compound diluted with diluent gases, which comprises mixing 0.1 to 30 vol. % of a transition metal compound with a first diluent gas to form a mixed gas of up to 200° C., supplying 1 to 30% by volume of said mixed gas and 96 to 55% by volume of a second diluent gas of at least 400° C., introducing said mixed gas and said second diluent gas into a reaction zone, while flowing 3–15% by volume of a third diluent gas around a current of the mixed gas and in the same flow direction as said current, and carrying out gas-phase pyrolysis in a magnetic field of at least 100 gauss, wherein said second diluent gas serves as a heat source of the gas phase pyrolysis.

2. The process according to claim 1, wherein said diluent gases are selected from the group consisting of hydrogen, an inert gas, carbon monoxide and a mixture thereof.

3. The process according to claim 1, wherein the transition metal of said carbonyl compound is selected from the group consisting of Fe, Ni, Co, W and Mo.

4. The process according to claim 1, wherein said magnetic field is 300 gauss or higher.

* * * * *

UNITED STATES PATENT AND TRADEMARK OFFICE

CERTIFICATE OF CORRECTION

PATENT NO. : 5,064,464

DATED : Nov. 12, 1991

INVENTOR(S) : YOSHIAKI SAWADA, et al.

It is certified that error appears in the above–identified patent and that said Letters Patent is hereby corrected as shown below:

Title page, item

[21] Appl. No.: Change "453,376" to --433,763--

Signed and Sealed this

Third Day of August, 1993

Michael K. Kirk

*Attest:*

MICHAEL K. KIRK

*Attesting Officer*

*Acting Commissioner of Patents and Trademarks*